US005348719A

United States Patent [19]

Yamamoto et al.

[11] Patent Number: 5,348,719

[45] Date of Patent: Sep. 20, 1994

[54] PROCESS FOR PRODUCING CARBON FIBERS HAVING HIGH STRAND STRENGTH

[75] Inventors: Iwao Yamamoto; Akihiko Yoshiya, both of Yokohama; Akira Nakagoshi, Kagawa, all of Japan

[73] Assignee: Mitsubishi Kasei Corporation, Tokyo, Japan

[21] Appl. No.: 795,376

[22] Filed: Nov. 21, 1991

[30] Foreign Application Priority Data

Nov. 21, 1990 [JP] Japan ..... 1-317426
Nov. 21, 1990 [JP] Japan ..... 1-317427

[51] Int. Cl.[5] ..... D01F 9/145

[52] U.S. Cl. ..... 423/447.4; 264/29.2; 423/447.8

[58] Field of Search ..... 423/460, 447.1, 447.2, 423/447.4, 447.7, 447.8; 264/29.2, 29.7

[56] References Cited

U.S. PATENT DOCUMENTS 3,772,429 11/1973 Basche et al. ..... 423/460
4,024,227 5/1977 Kishimoto et al. ..... 423/447.4
4,032,430 6/1977 Lewis ..... 423/447.1
4,362,646 12/1982 Ikegami et al. ..... 423/447.2
4,412,937 11/1983 Ikegami et al. ..... 423/447.4
4,814,145 3/1989 Yoshida et al. ..... 422/150
4,921,686 5/1990 Yoshida et al. ..... 423/460
4,975,263 12/1990 Furuyama et al. ..... 423/447.1
5,047,292 9/1991 Sadanobu et al. ..... 423/447.1

FOREIGN PATENT DOCUMENTS 2302128 10/1976 France .
167927 8/1985 Japan .
03-906624 4/1991 Japan ..... 423/447.7

*Primary Examiner*—Michael Lewis
*Assistant Examiner*—Stephen G. Kalinchak
*Attorney, Agent, or Firm*—Oblon, Spivak, McClelland, Maier & Neustadt

[57] ABSTRACT

A process for producing carbon fibers having high strand strength, which comprises subjecting pitch fibers obtained by melt-spinning pitch, followed by gathering, to infusible treatment to obtain infusible fibers, followed by carbonization treatment, and if necessary, graphitization treatment, to obtain carbon fibers, wherein the infusible fibers or the carbon fibers are heat-treated in an atmosphere containing steam or carbon dioxide at a temperature of from 500° to 1,800° C.

9 Claims, 2 Drawing Sheets

PROCESS FOR PRODUCING CARBON FIBERS HAVING HIGH STRAND STRENGTH

The present invention relates to a process for producing pitch-type carbon fibers. More particularly, it relates to a process for producing carbon fibers having high strand strength.

Carbon fibers are fibers which possess high specific strength and high specific modulus and are expected to be useful as fibrous fillers for high performance composite materials.

At present, PAN-type carbon fibers prepared from polyacrylonitrile (PAN) as starting material and pitch-type carbon fibers prepared from pitch as starting material, are available as carbon fibers. However, PAN-type is more widely used, since its development has been generally more advanced. As high performance carbon fibers with high strength and high elasticity, PAN-type carbon fibers are mainly used with various modifications applied thereto.

However, PAN-type carbon fibers have a limitation in the improvement of the elasticity. Further, they have difficulties such that their starting material PAN is expensive, and the yield of carbon fibers per starting material is low.

Under these circumstance, various studies have been made in recent years to improve the properties of pitch-type carbon fibers which have a feature of higher elasticity and which are expected to have a wider range of applications.

Improvement of the properties of pitch-type carbon fibers has been conducted mainly by controlling the nature of spinning pitch, since a method was first proposed in which so-called mesophase pitch i.e. pitch obtained by heat-treating raw material pitch and having anisotropy developed and having readily orientable molecular species formed, was used instead of isotropic pitch which used to be employed as spinning material (Japanese Examined Patent Publication No. 8634/1974).

For example, Japanese Unexamined Patent Publication No. 19127/1974 proposes a method in which pitch material is heat-treated under an inert gas atmosphere to form a highly oriented mesophase, and pitch containing from 40 to 90% by weight of such mesophase, is used as pitch material for spinning.

However, it takes a long period of time to convert isotropic raw material pitch to mesophase pitch by such a method. Therefore, Japanese Unexamined Patent Publication No. 160427/1979 proposes a method wherein raw material pitch is preliminarily treated with an adequate amount of a solvent so that the conversion to mesophase pitch can be conducted in a short period of time. Namely, raw material pitch is treated with a solvent such as benzene or toluene to obtain its insoluble content, which is heat-treated at a temperature of from 230° to 400° C. for a short time of not more than 10 minutes to form so-called neomesophase which is highly oriented with an optically anisotropic portion being at least 7.5% by weight and which has a quinoline-insoluble content of not higher than 25% by weight, and such neomesophase is used as spinning pitch.

The spinning pitch thus obtained is subjected to melt-spinning to obtain pitch fibers, followed by infusible treatment, carbonization or graphitization to obtain high performance carbon fibers having high strength, high elasticity, etc.

Carbon fibers thus obtained are usually impregnated with a matrix resin such as an epoxy resin, a polyamide resin or a phenol resin to obtain a so-called prepreg, which is molded by various molding methods and used as fiber-reinforced plastics for various leisure and sporting goods or as various industrial materials. Accordingly, in order to obtain mechanical properties for the above-mentioned carbon fiber-reinforced plastics, it is important not only to attain mechanical properties such as high strength and high elasticity of individual carbon fibers themselves but also to have carbon fibers well dispersed in the matrix resin so that the mechanical properties of the carbon fibers themselves can adequately be utilized.

In other words, even if the strength and the elastic modulus of the carbon fibers are high, if the dispersion of the fibers in the matrix resin is poor, the mechanical function of the carbon fiber-reinforced plastics will be inadequate.

Therefore, for the dispersibility in the matrix resin, carbon fibers to be used must be free from fusion of monofilaments to one another, i.e. carbon fibers must be sufficiently fibrillated.

Namely, fibers subjected to infusible treatment (hereinafter referred to simply as infusible fibers) and fibers subjected to carbonization or graphitization treatment (hereinafter referred to simply as carbon fibers) in the process for the production of pitch-type carbon fibers are likely to undergo fusion of monofilaments to one another and tend to show nonuniformity in quality due to e.g. thermal modification of the oiling agent such as a gathering agent or a sizing agent used in the previous step or due to a thermal modification of fibers themselves, whereby the dispersion of monofilaments in the matrix resin tends to be nonuniform, and the uniformity of the complex material tends to be impaired. Therefore, they have to be fibrillated to a flexible state free from fusion at a stage of infusible, carbonization or graphitization treatment.

Heretofore, as a method of fibrillating infusible fibers or carbon fibers, there have been known a method wherein turbulent flow treatment is applied to the fibers, a bending treatment method wherein the fibers are passed in a zig-zag fashion along guides such as rotary pins, a method wherein the fibers are contacted on a curved surface of a roll having a convex curved surface (Japanese Unexamined Patent Publication No. 57015/1980), a method wherein the fibers are contacted to inclined surfaces of at least two tapered rollers (Japanese Unexamined Patent Publication No. 124645/1986) and a method wherein the fibers are fibrillated in a fluid (Japanese Unexamined Patent Publication No. 89638/1982). Further, a method for improving fibrillation or carbon fiber strength by treating the surface of carbon fibers or infusible fibers with a gas containing oxygen has been known (Japanese Unexamined Patent Publications No. 215716/1986, No. 665523/1988 and No. 175122/1988). This is intended to accomplish the object by etching the fiber surface to some extent by the treatment of the carbon fibers in an inert gas containing oxygen.

However, the conventional method such as a mechanical fibrillating method requires a high installation cost, and yet, the fibrillating performance is still inadequate. On the other hand, anodic oxidation as a method for improving the surface area requires a complicated apparatus or operation, and the improvement of the surface area is still small, and there is a problem of e.g. waste liquid treatment.

Further, even if carbon fibers or graphite fibers treated for carbonization at a high temperature in an inert atmosphere, are heat-treated in an inert gas atmosphere containing oxygen, the effects for improving the surface area is not substantial, since the fiber surface has been already stabilized and inactive. Besides, oxygen gas reacts with carbon fibers while accompanying substantial heat generation, whereby it is practically difficult to control the reaction, and it has been difficult to obtain carbon fibers having sufficiently high strand strength, as peroxidation reaction proceeds at some filaments.

The present inventors have conducted extensive research for a method of improving fibrillation and strand strength of pitch-type carbon fibers. As a result, it has been surprisingly found an epoch-making method whereby carbon fibers having excellent fibrillating properties and high strand strength can be produced by heat-treating infusible fibers or carbon fibers under an atmosphere containing steam or carbon dioxide.

Further, it has been found possible to freely control the strength and the elastic modulus of fibers depending upon the particular purpose by subjecting the carbon fibers thus obtained to secondary carbonization treatment in an inert atmosphere at a temperature higher than the above primary carbonization temperature. The present invention has been accomplished on the basis of these discoveries.

Namely, it is an object of the present invention to provide a process for producing carbon fibers having excellent fibrillating properties and high strand strength.

Another object of the present invention is to provide a process for producing carbon fibers having high strand strength, whereby the strength and the elastic modulus of the fibers can freely be controlled.

A still further object of the present invention is to provide a process for producing carbon fibers having high strand strength which is capable of providing a resin-impregnated strand strength which is comparable to the strength of monofilaments themselves, particularly with the strength of monofilaments themselves as determined by JIS R-7601-1986, 6.6.1.

Such objects of the present invention can be readily accomplished by a process for producing carbon fibers having high strand strength, which comprises subjecting pitch fibers obtained by melt-spinning pitch, followed by gathering, to infusible treatment to obtain infusible fibers, followed by carbonization treatment, and if necessary, graphitization treatment, to obtain carbon fibers, wherein the infusible fibers or the carbon fibers are heat-treated in an atmosphere containing steam or carbon dioxide at a temperature of from 500° to 1,800° C.

BRIEF DESCRIPTION OF DRAWINGS

In the accompanying drawings.

Figure 1:
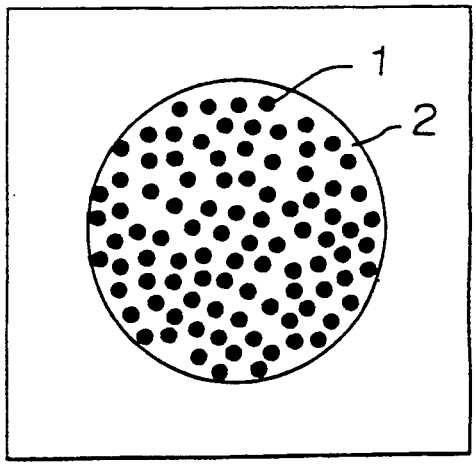
FIGS. 1, 2 and 3 are diagrammatic views of visual fields when cross sections of carbon fibers were observed by an optical microscope.

Now, the present invention will be described in detail.

The spinning pitch to be used in the present invention to obtain carbon fibers, is not particularly limited so long as readily orientable molecular species are formed therein and it is capable of presenting optically anisotropic carbon fibers. Various types as described above may be employed.

Carbonaceous raw material from which such spinning pitch is to be obtained, may, for example, be coal-originated coal tar, coal tar pitch or liquefied coal, petroleum-originated heavy oil, tar or pitch, or a polymerization reaction product obtained by a catalytic reaction of naphthalene or anthracene. Such carbonaceous raw material contains impurities such as free carbon, non-dissolved coal, ash or the catalyst. It is advisable to preliminarily remove such impurities by a conventional method such as filtration, centrifugal separation or sedimentation separation by means of a solvent.

Further, the above carbonaceous raw material may be subjected to pretreatment by e.g. a method wherein the carbonaceous raw material is heat-treated and then any-soluble content is extracted with a certain specific solvent, or a method wherein the carbonaceous raw material is subjected to hydrogenation treatment in the presence of hydrogen gas and a hydrogen-donative solvent.

In the present invention, it is preferred to employ a carbonaceous raw material containing at least 40%, preferably at least 70%, more preferably at least 90% of an optically anisotropic structure. For this purpose, the above-mentioned carbonaceous raw material or pretreated carbonaceous raw material, may be heat-treated usually at a temperature of from 350° to 500° C., preferably from 380° to 450° C. for from 2 minutes to 50 hours, preferably from 5 minutes to 5 hours under an inert gas atmosphere such as nitrogen, argon or steam, or while blowing such an inert gas into the system, as the case requires.

In the present invention, the proportion of the optically anisotropic structure in the pitch means a value obtained as the proportion of area corresponding to the portion showing an optical anisotropy in the pitch sample as observed by a polarizing microscope at room temperature.

Specifically, for example, a pitch sample is crushed to an angular size of a few mm, and sample fragments thus obtained are embedded substantially over the entire surface of the resin having a diameter of 2 cm in accordance with a conventional method. The resin surface is polished, and then the entire surface is observed under a polarizing microscope (100 magnifications ) to measure the proportion of the area corresponding to the optically anisotropic portions in the entire surface area of the sample.

Using such spinning pitch as described above, melt-spinning, gathering, infusible treatment and carbonization treatment are conducted by conventional methods to obtain carbon fibers.

The carbonization treatment is conducted under an inert gas atmosphere such as nitrogen or argon within a temperature range of from 400° to 1,800° C., preferably from 400° to 1,400° C., usually for from 10 seconds to 6 hours, preferably from 1 minute to 2 hours.

Further, depending upon the particular use, the carbon fibers are sometimes required to have a higher absolute value of strength. In a case where carbon fibers with higher mechanical performance such as higher strength or elastic modulus than the carbon fibers obtainable by the above process, are required, such a requirement can be attained by subjecting the fibers after the above heat-treatment to secondary carbonization treatment or graphitization treatment under an inert atmosphere at a temperature higher than the above carbonization temperature.

The temperature for such secondary carbonization treatment or graphitization treatment may be determined depending upon the required mechanical properties such as strength and elastic modulus, but it is important that the temperature is higher than the temperature for the primary carbonization treatment.

Namely, if the temperature for the secondary carbonization treatment or graphitization treatment is lower than the primary carbonization treatment temperature, such secondary carbonization treatments or graphitization treatment will not substantially contribute to improvement of the mechanical properties of carbon fibers. The temperature for the secondary carbonization treatment or graphitization treatment is preferably from 800° to 3,000° C. If the temperature is lower than 800° C., improvement of the mechanical properties of the fibers is little. On the other hand, if the temperature exceeds 3,000° C., the degree of further improvement of the mechanical properties by the temperature rise tends to be little while the cost for heating is substantial, such being industrially not advantageous.

In the present invention, such infusible fibers or carbon filters are then heat-treated under a steam atmosphere or a carbon dioxide atmosphere or under an atmosphere of gas mixture comprising steam or carbon dioxide and an inert gas such as nitrogen gas or argon gas within a temperature range of from 500° to 1,800° C., preferably from 700° to 1,400° C. usually for from 0.1 second to 24 hours, preferably from one second to 6 hours. The concentration of carbon dioxide is usually from 1,000 ppm to 100 vol. %, preferably from 5,000 ppm to 100 vol. %. Likewise, the concentration of steam is usually from 100 ppm to 100 vol. %, preferably from 1,000 ppm to 100 vol. %.

The concentration of steam or carbon dioxide in the present invention is substantially influenced by the treating temperature or treating time. For example, when the treatment is conducted at a high temperature or for a long period of time, it is preferred to conduct the treatment at a low concentration of steam or carbon dioxide. On the other hand, if the treatment is conducted at a low temperature, or for a short period of time, it is preferred to conduct the treatment at a high concentration of steam or carbon dioxide.

With a view to obtaining effects of the present invention such that the fibrillating properties are excellent and high strength is attained in either form of monofilaments or resin-impregnated strands, the following treating conditions are preferred for practical industrial operation. Namely, the steam treatment is conducted preferably at a temperature of from 1,050° C. to 1,400° C. for from 5 seconds to 90 minutes at a concentration of from 3,000 ppm to 60 vol. %. The carbon dioxide treatment is conducted preferably at a temperature of from 1,050° C. to 1,400° C. for from 5 seconds to 90 minutes at a concentration of from 5,000 ppm to 70 vol. %.

This secondary carbonization treatment or graphitization treatment is conducted as the case requires for the purpose of improving mechanical properties of the carbon fibers. So long as the secondary carbonization treatment or graphitization treatment does not adversely affect the effects for improving fibrillation and strand strength of carbon fibers obtained by heat-treatment in the steam or carbon dioxide-containing atmosphere, such secondary carbonization treatment or graphitization treatment as well as surface treatment, may be conducted after the heat-treatment in the steam or carbon dioxide-containing atmosphere. As described in the foregoing, substantial improvement of the fibrillation and strand strength of the infusible fibers or carbon fibers can be accomplished by heat-treating the infusible fibers or carbon fibers in an atmosphere containing steam or carbon dioxide at a temperature of from 500° to 1,800° C. According to the process of the present invention, fibers are fibrillated, whereby the dispersibility of monofilaments in the matrix resin has been improved, and the strand strength has been improved. Further, monofilament strength as observed per each monofilament unit, has also been improved. This includes the effect obtained by removing the surface defects created by fusion among monofilaments to one another by etching with steam or carbon dioxide gas.

As mentioned above, an attempt to remove surface defects, etc. by etching has been made in the prior art, but such an attempt was always by a method which accompanied substantial heat generation by e.g. oxygen gas. The substantial effects obtained by steam or carbon dioxide gas in the present invention are believed to be attributable to the fact that the reaction between steam ($H_2O$) or carbon dioxide ($CO_2$) and the carbon atoms on the carbon fiber surface is an endothermic reaction or a slightly exothermic reaction at a temperature of from 500° to 1,800° C., whereby no deterioration in the strength due to peroxidation takes place.

Now, the present invention will be described in further detail with reference to Examples. However, it should be understood that the present invention is by no means restricted to such specific Examples.

EXAMPLE 1

From coal tar pitch, spinning pitch having a softening point of 300° C. and a proportion of optical anisotropy of 95% as observed under a polarizing microscope, was prepared.

This spinning pitch was melt-spun at a spinneret temperature of 330° C. by means of a spinneret having 4,000 nozzles with a nozzle diameter of 0.1 mm. A silicon-type oiling agent was applied to obtained pitch fibers having a filament diameter of 12 μm, and then the fibers were gathered.

The pitch fibers were then heat-treated in air at 310° C. for 30 minutes to obtain infusible fibers. The infusible fibers were carbonized in nitrogen gas at 545° C. to obtain carbon fibers.

The carbon fibers were heat-treated in a continuous system heating furnace with a nitrogen gas atmosphere containing 8,400 ppm of steam at 1,200° C. for a residence time of 20 minutes.

The carbon fibers thus obtained are free from fusion of fibers to one another. The fibers were impregnated in a matrix epoxy resin and then dried and cured at 130° C. for 30 minutes, whereupon the cross section to the longitudinal direction of the carbon fibers was observed by a microscope, whereby as shown in FIG. 1, the fibers showed excellent uniformity with monofilaments 1 uniformly dispersed in the epoxy resin matrix 2.

Further, the monofilament physical properties and the resin-impregnated strand physical properties of the fibers thus obtained were measured in accordance with the method of JIS R-7601, whereby the following results were obtained.

Monofilament physical properties

Tensile strength: 330 kgf/mm$^2$

Tensile modulus of elasticity: 19 tonf/mm$^2$

Resin impregnated strand physical properties

Tensile strength: 300 kgf/mm$^2$

Tensile modulus of elasticity: 21 tonf/mm$^2$

EXAMPLE 2

The operation was conducted in the same manner as in Example 1 except that the residence time at 1,200° C. in the nitrogen gas atmosphere containing 8,400 ppm of steam was changed to 30 minutes.

Various properties of the fibers thus obtained were measured in the same manner as in Example 1, and the results are shown in Table 1.

EXAMPLE 3

The operation was conducted in the same manner as in Example 1 except that about 50 m of carbon fibers carbonated at 545° C. were charged into a batch system heating furnace and heat-treated in a nitrogen gas containing 8,000 ppm of steam at 1,200° C. for a residence time of 60 minutes.

Various properties of the fibers thus obtained were measured in the same manner as in Example 1, and the results are shown in Table 1.

EXAMPLE 4

The operation was conducted in the same manner as in Example 1 except that the concentration of steam in nitrogen was changed to 12 vol. %, and the residence time at 1,200° C. was changed to 30 seconds.

Various properties of the fibers thus obtained were measured in the same manner as in Example 1, and the results are shown in Table 1.

EXAMPLE 5

The tow of carbon fibers obtained in Example 3 was further subjected to graphitization treatment in argon gas at 2,150° C. for a residence time of 0.5 minute.

Various properties of the fibers thus obtained were measured in the same manner as in Example 1, and the results are shown in Table 1.

EXAMPLE 6

The operation was conducted in the same manner as in Example 1 except that the steam concentration in nitrogen was changed to 49 vol. %, and the residence time at 1,200° C. was changed to 10 seconds.

Various properties of the fibers thus obtained were measured, and the results are shown in Table 1.

EXAMPLE 7

The tow of carbon fibers obtained in Example 5 was further subjected to graphitization treatment in argon gas at 2,500° C. for a residence time of 1 minute.

Various properties of the fibers thus obtained were measured in the same manner as in Example 1, and the results are shown in Table 1.

EXAMPLE 8

Infusible fibers used in Example 1, were heat-treated in a nitrogen gas atmosphere containing 8,400 ppm of steam at 1,200° C. for a residence time of 30 minutes.

Various properties of the fibers thus obtained were measured in the same manner as in Example 1, and the results are shown in Table 1.

EXAMPLE 9

The operation was conducted in the same manner as in Example 1 except that the heat treating temperature in the nitrogen gas atmosphere containing 8,400 ppm of steam was changed to 850° C. The tow of carbon fibers thereby obtained was further subjected to heat treatment in a nitrogen gas atmosphere at 1,200° C. for a residence time of 20 minutes.

Figure 2:
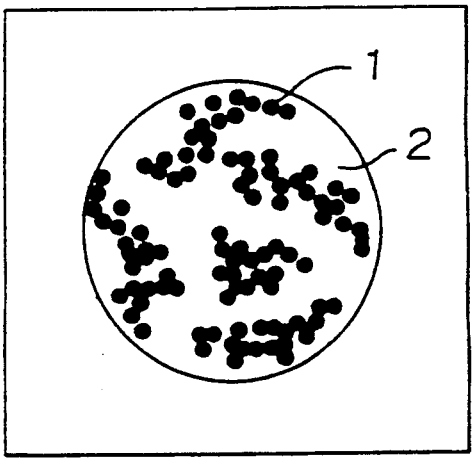

Various properties of the fibers thus obtained were measured in the same manner as in Example 1, and the results are shown in Table 1 and FIG. 2.

EXAMPLE 10

The operation was conducted in the same manner as in Example 1 except that the steam concentration in the nitrogen gas was changed to 49 vol. %, the heat treating temperature was changed to 850° C. and the residence time was changed to 3 minutes. The tow of carbon fibers thereby obtained was further subjected to heat treatment in a nitrogen gas atmosphere at 1,200° C. for a residence time of 20 minutes.

Various properties of the fibers thus obtained were measured in the same manner as in Example 1, and the results are shown in Table 1.

COMPARATIVE EXAMPLE 1

The operation was conducted in the same manner as in Example 1 except that the atmosphere gas for the heat-treatment at 1,200° C. was changed to nitrogen gas.

Figure 3:
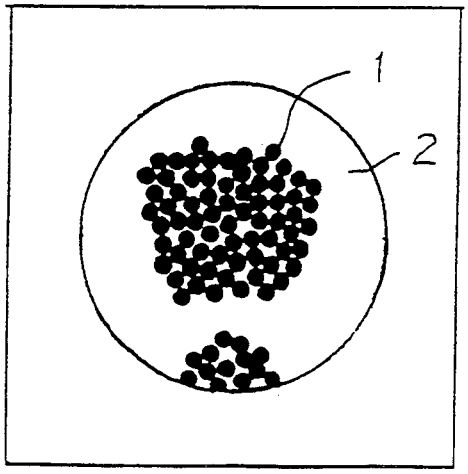

Various properties of the fibers thus obtained were measured in the same manner as in Example 1, and the results are shown in Table 1 and FIG. 3.

As is evident from Table 1 and FIG. 3, the carbon fibers obtained here had poor dispersibility in the epoxy resin matrix, and the strand strength thereof was low.

COMPARATIVE EXAMPLE 2

The operation was conducted in the same manner as in Example 1 except that the atmosphere for the heat-treatment at 1,200° C. was changed to nitrogen gas containing 400 ppm of oxygen gas.

Various properties of the fibers thus obtained were measured in the same manner as in Example 1, and the results are shown in Table 1.

TABLE 1

| | | Heat treatment | | | Graphitization | | | Monofilament physical properties | | Resin-impregnated strand properties | |
|---|---|---|---|---|---|---|---|---|---|---|---|
| | Fibers treated | Atmosphere | Temp. (°C.) | Time (min.) | Temp. (°C.) | Time (min.) | Fibrillating properties* | Tensile strength (kgf/mm$^2$) | Tensile modulus of elasticity (tonf/mm$^2$) | Tensile strength (kgf/mm$^2$) | Tensile modulus of elasticity (tonf/mm$^2$) |
| Example 1 | Carbon fibers | $H_2O:N_2$ 8,400 ppm | 1,200 | 20 | — | — | ◎ | 330 | 19 | 300 | 21 |
| Example 2 | Carbon fibers | $H_2O:N_2$ 8,400 ppm | 1,200 | 30 | — | — | ◎ | 300 | 18 | 290 | 22 |
| Example 3 | Carbon fibers | $H_2O:N_2$ 8,000 ppm | 1,200 | 60 (batch) | — | — | ◎ | 290 | 18 | 300 | 21 |

TABLE 1-continued

| | Fibers treated | Heat treatment Atmosphere | Heat treatment Temp. (°C.) | Heat treatment Time (min.) | Graphitization Temp. (°C.) | Graphitization Time (min.) | Fibrillating properties* | Monofilament physical properties Tensile strength (kgf/mm²) | Monofilament physical properties Tensile modulus of elasticity (tonf/mm²) | Resin-impregnated strand properties Tensile strength (kgf/mm²) | Resin-impregnated strand properties Tensile modulus of elasticity (tonf/mm²) |
|---|---|---|---|---|---|---|---|---|---|---|---|
| Example 4 | Carbon fibers | $H_2O:N_2$ 12% | 1,200 | 0.5 | — | — | ◎ | 240 | 15 | 270 | 18 |
| Example 5 | Carbon fibers | $H_2O:N_2$ 12% | 1,200 | 0.5 | 2,150 | 0.5 | ◎ | 360 | 46 | 350 | 51 |
| Example 6 | Carbon fibers | $H_2O:N_2$ 49% | 1,200 | 0.17 | — | — | ◎ | 220 | 14 | 240 | 16 |
| Example 7 | Carbon fibers | $H_2O:N_2$ 49% | 1,200 | 0.17 | 2,500 | 1 | ◎ | 420 | 65 | 400 | 71 |
| Example 8 | Infusible fibers | $H_2O:N_2$ 8,400 ppm | 1,200 | 30 | — | — | ◎ | 300 | 18 | 290 | 22 |
| Example 9 | Carbon fibers | $H_2O:N_2$ 8,400 ppm | 850 | 20 | 1,200 | 20 | Δ | 270 | 20 | 210 | 22 |
| Example 10 | Carbon fibers | $H_2O:N_2$ 49% | 850 | 3 | 1,200 | 20 | Δ | 280 | 20 | 240 | 22 |
| Comparative Example 1 | Carbon fibers | $N_2$ | 1,200 | 20 | — | — | X | 260 | 20 | 180 | 22 |
| Comparative Example 2 | Carbon fibers | $O_2:N_2$ 400 ppm | 1,200 | 20 | — | — | ○ | 210 | 18 | 200 | 20 |

*
◎: Excellent (as shown in FIG. 1)
○: Good (most fibers are dispersed at a monofilament level although non-dispersed portions of a few or a few tens filaments are observed.)
Δ: Slightly poor (as shown in FIG. 2, fibers are dispersed in units of a few or a few tens filaments.)
X: Poor (as shown in FIG. 3)

EXAMPLE 11

The operation was conducted in the same manner as in Example 1 except that the carbon fibers carbonated at 545° C. was heat-treated in a nitrogen gas atmosphere containing 2 vol. % of carbon dioxide at 1,200° C. for a residence time of 20 minutes.

Various properties of the fibers thus obtained were measured in the same manner as in Example 1, and the results are shown in Table 2.

EXAMPLE 12

The operation was conducted in the same manner as in Example 11 except that the concentration of carbon dioxide in nitrogen was changed to 25 vol. %, and the residence time at 1,200° C. was changed to 30 seconds.

Various properties of the fibers thus obtained were measured in the same manner as in Example 1, and the results are shown in Table 2.

EXAMPLE 13

The carbon fibers obtained in Example 9 were further subjected to graphitization treatment in argon gas at 2,150° C. for a residence time of 0.5 minute.

Various properties of the fibers thus obtained were measured in the same manner as in Example 1, and the results are shown in Table 2.

EXAMPLE 14

The infusible fibers used in Example 1 were heat-treated in a nitrogen gas atmosphere containing 2 vol. % of carbon dioxide at 1,200° C. for a residence time of 30 minutes.

Various properties of the fibers thus obtained were measured in the same manner as in Example 1, and the results are shown in Table 2.

EXAMPLE 15

The operation was conducted in the same manner as in Example 11 except that the carbon dioxide concentration in nitrogen was changed to 50 vol. %, the heat treating temperature was changed to 850° C., and the residence time was changed to 20 minutes.

The tow of carbon fibers thereby obtained, was further subjected to heat treatment in a nitrogen gas atmosphere at 1,200° C. for a residence time of 20 minutes.

Various properties of the fibers thus obtained were measured in the same manner as in Example 1, and the results are shown in Table 2.

TABLE 2

| | Fibers treated | Heat treatment Atmosphere | Heat treatment Temp. (°C.) | Heat treatment Time (min.) | Graphitization Temp. (°C.) | Graphitization Time (min.) | Fibrillating properties* | Monofilament physical properties Tensile strength (kgf/mm²) | Monofilament physical properties Tensile modulus of elasticity (tonf/mm²) | Resin-impregnated strand properties Tensile strength (kgf/mm²) | Resin-impregnated strand properties Tensile modulus of elasticity (tonf/mm²) |
|---|---|---|---|---|---|---|---|---|---|---|---|
| Example 11 | Carbon fibers | $CO_2:N_2$ 2% | 1,200 | 20 | — | — | ◎ | 320 | 20 | 300 | 21 |
| Example 12 | Carbon fibers | $CO_2:N_2$ 25% | 1,200 | 0.5 | — | — | ◎ | 250 | 16 | 270 | 18 |
| Example 13 | Carbon fibers | $CO_2:N_2$ 25% | 1,200 | 0.5 | 2,150 | 0.5 | ◎ | 370 | 47 | 360 | 50 |

TABLE 2-continued

| | Fibers treated | Heat treatment | | | Graphitization | | Fibrillating properties* | Monofilament physical properties | | Resin-impregnated strand properties | |
|---|---|---|---|---|---|---|---|---|---|---|---|
| | | Atmosphere | Temp. (°C.) | Time (min.) | Temp. (°C.) | Time (min.) | | Tensile strength (kgf/mm$^2$) | Tensile modulus of elasticity (tonf/mm$^2$) | Tensile strength (kgf/mm$^2$) | Tensile modulus of elasticity (tonf/mm$^2$) |
| Example 14 | Infusible fibers | $CO_2$:$N_2$ 2% | 1,200 | 30 | — | — | ◎ | 310 | 20 | 300 | 22 |
| Example 15 | Carbon fibers | $CO_2$:$N_2$ 50% | 850 | 20 | 1,200 | 20 | Δ | 270 | 20 | 230 | 22 |

*
◎: Excellent (as shown in FIG. 1)
Δ: Slightly poor (as shown in FIG. 2, fibers are dispersed in units of a few or a few tens filaments.)

As described in the foregoing, the present invention provides a process for producing carbon fibers having high strand strength which have excellent fibrillating properties and high strand strength and which are capable of providing a resin-impregnated strand strength comparable to the strength of monofilaments themselves.

What is claimed is:

1. A process for producing carbon fibers, which consists essentially of:

preparing pitch fibers by melt-spinning pitch, at least 40% of which is of an optically anisotropic structure;

gathering the resulting fibers;

infusibilizing the gathered fibers;

carbonizing the infusibilized fibers at a temperature of 400° to 1800° C. in an inert gas;

if necessary, graphitizing said carbonized fibers; and heat treating said infusibilized fibers or carbonized fibers at a temperature of from 500°–1800° C. in an atmosphere consisting essentially of an inert gas with an effective amount of at least one of steam and carbon dioxide to enhance the tensile strength of the carbon strand product to a level of at least 210 kg/mm$^2$.

2. The process for producing carbon fibers according to claim 1, wherein the heat-treatment in the atmosphere containing steam or carbon dioxide is conducted at a temperature of from 1,050° to 1,400° C.

3. The process for producing carbon fibers according to claim 1, wherein the concentration of steam in the steam-containing atmosphere is within a range of from 1,000 ppm to 100 vol. %.

4. The process for producing carbon fibers according to claim 1, wherein the concentration of carbon dioxide in the carbon dioxide-containing atmosphere is within a range of from 5,000 ppm to 100 vol. %.

5. The process for producing carbon fibers according to claim 2, wherein the heat-treatment in the atmosphere containing steam or carbon dioxide is conducted for from 0.1 second to 24 hours.

6. The process for producing carbon fibers according to claim 1, wherein the infusible fibers or the carbon fibers having been heat-treated in the atmosphere containing steam or carbon dioxide, are further subjected to carbonization or graphitization treatment.

7. The process for producing carbon fibers according to claim 3, wherein the heat treatment in the atmosphere containing steam is conducted at a temperature of from 1,050° C. to 1,400° C. for from 5 seconds to 90 minutes at a concentration of steam of from 3,000 ppm to 60 vol. %.

8. The process for producing carbon fibers according to claim 4, wherein the heat treatment in the atmosphere containing carbon dioxide is conducted at a temperature of from 1,050° C. to 1,400° C. for from 5 seconds to 90minutes at a concentration of carbon dioxide of from 5,000 ppm to 70 vol. %.

9. The process for producing carbon fibers according to claim 1, wherein said inert gas is nitrogen or argon.

* * * * *

UNITED STATES PATENT AND TRADEMARK OFFICE

CERTIFICATE OF CORRECTION

PATENT NO. : 5,348,719

DATED : September 20, 1994

INVENTOR(S) : Iwao YAMAMOTO, et al.

It is certified that error appears in the above-indentified patent and that said Letters Patent is hereby corrected as shown below:

On the title page, Item [30], the Foreign Application Priority Numbers are incorrect. They should read as follows:

--2-317426--
and
--2-317427--

Signed and Sealed this

Thirteenth Day of December, 1994

*Attest:*

BRUCE LEHMAN

*Attesting Officer*

*Commissioner of Patents and Trademarks*